United States Patent [19]

Quick et al.

[11] 4,025,714

[45] May 24, 1977

[54] SELF-LOCKING TERMINAL ASSEMBLY

[75] Inventors: Kenneth L. Quick, Oglesby; Dennis R. Blevins, Peru, both of Ill.

[73] Assignee: Electrical Utilities Company, LaSalle, Ill.

[22] Filed: Apr. 4, 1975

[21] Appl. No.: 565,011

[52] U.S. Cl. ..... 174/18; 174/31 R; 174/153 R

[51] Int. Cl.[2] ..... H01B 17/30

[58] Field of Search ..... 339/94, 126, 214, 218, 339/220, 129–131; 174/52 S, 153 R, 18, 31 R

[56] References Cited

UNITED STATES PATENTS

| | | | |
|---|---|---|---|
| 2,388,054 | 10/1945 | Hartzell | 174/153 R |
| 2,443,545 | 6/1948 | Schwennesen | 174/153 R |
| 2,450,423 | 10/1948 | Fraser et al. | 174/52 S |
| 2,788,386 | 4/1957 | McCarty | 174/153 R |
| 2,812,381 | 11/1957 | May | 174/153 R |

*Primary Examiner*—Roy Lake
*Assistant Examiner*—Neil Abrams
*Attorney, Agent, or Firm*—Allegretti, Newitt, Witcoff & McAndrews

[57] ABSTRACT

A self-locking terminal assembly mountable on a base or plate. The terminal assembly includes an integral, one-piece terminal stud, an interior insulating member and an exterior insulating member. In an assembled state, the terminal stud, internal insulating member, external insulating member and mounting base interlock to substantially avoid rotation of the terminal assembly with respect to the base, under an applied torque.

12 Claims, 8 Drawing Figures

SELF-LOCKING TERMINAL ASSEMBLY

BACKGROUND OF THE INVENTION

The present invention relates generally to an electrical terminal assembly and, more particularly, to a self-locking capacitor terminal assembly.

In high-current capacitor applications, where a conductor is connected to a terminal assembly mounted on the capacitor can or a cabinet housing a series of electrically interconnected capacitors, it is necessary that the conductor-terminal connection be secure and tight. To achieve this result, an axial torque is often applied to the terminal assembly. For example, the terminal assembly may be threaded to receive a cooperatively threaded conductor.

The terminal assembly must have the capability to withstand the high axial torque utilized to fasten and secure the conductor. Rotation of the assembly with respect to the can or cabinet, under the applied torque, can cause breakage or grounding of the internal conductor, connecting the terminal assembly with either the capacitor pack or series of capacitors, as indicated above.

In addition to providing a torque resistance, the terminal assembly must also be hermetically sealable, when mounted on a capacitor can or cover. Such sealing is necessary to substantially avoid leakage of the capacitor dielectric.

SUMMARY OF THE INVENTION

In a principal aspect, the present invention is a self-locking terminal assembly mountable on a base or cover. The assembly includes an integral, one-piece conductive terminal stud, an interior insulating member and an exterior insulating member. In the assembled state, the terminal stud, interior insulating member, exterior insulating member and mounting base mutually interlock. The interior and exterior insulating members telescopically interlock through the mounting base to secure and clamp the terminal assembly to the base. The conductive terminal stud extends through the interior and exterior insulating members, interlocking therewith.

The mutual interlocking of terminal components substantially avoids rotation of the terminal assembly with respect to the mounting base under an applied torque. Appropriate sealing means may be provided, particularly in hermetic applications.

It is thus an object of the present invention to provide a mountable terminal assembly capable of withstanding high axial torques.

It is a further object of the present invention to provide an anti-rotation terminal assembly for high current applications wherein the conductive terminal stud is a single, one-piece construction.

It is also an object of the present invention to provide a terminal assembly wherein the terminal components substantially align to facilitate assembly thereof.

It is another object of the present invention to provide a hermetically sealed terminal assembly.

It is an additional object of the present invention to provide a mountable terminal assembly wherein the terminal stud, insulating members and mounting base mutually interlock to substantially avoid rotation of the terminal assembly with respect to the base under an applied torque.

It is a further object of the present invention to provide a mountable terminal assembly for use in combination with a capacitor or series thereof.

It is also an object of the present invention to provide an inexpensive, readily manufactured and assembled terminal assembly.

These and other objects, advantages and features of the present invention will become apparent in the following detailed description.

BRIEF DESCRIPTION OF THE DRAWINGS

A preferred embodiment of the present invention will be described, in detail, with reference to the drawing wherein.

DETAILED DESCRIPTION OF A PREFERRED EMBODIMENT

Figure 1:
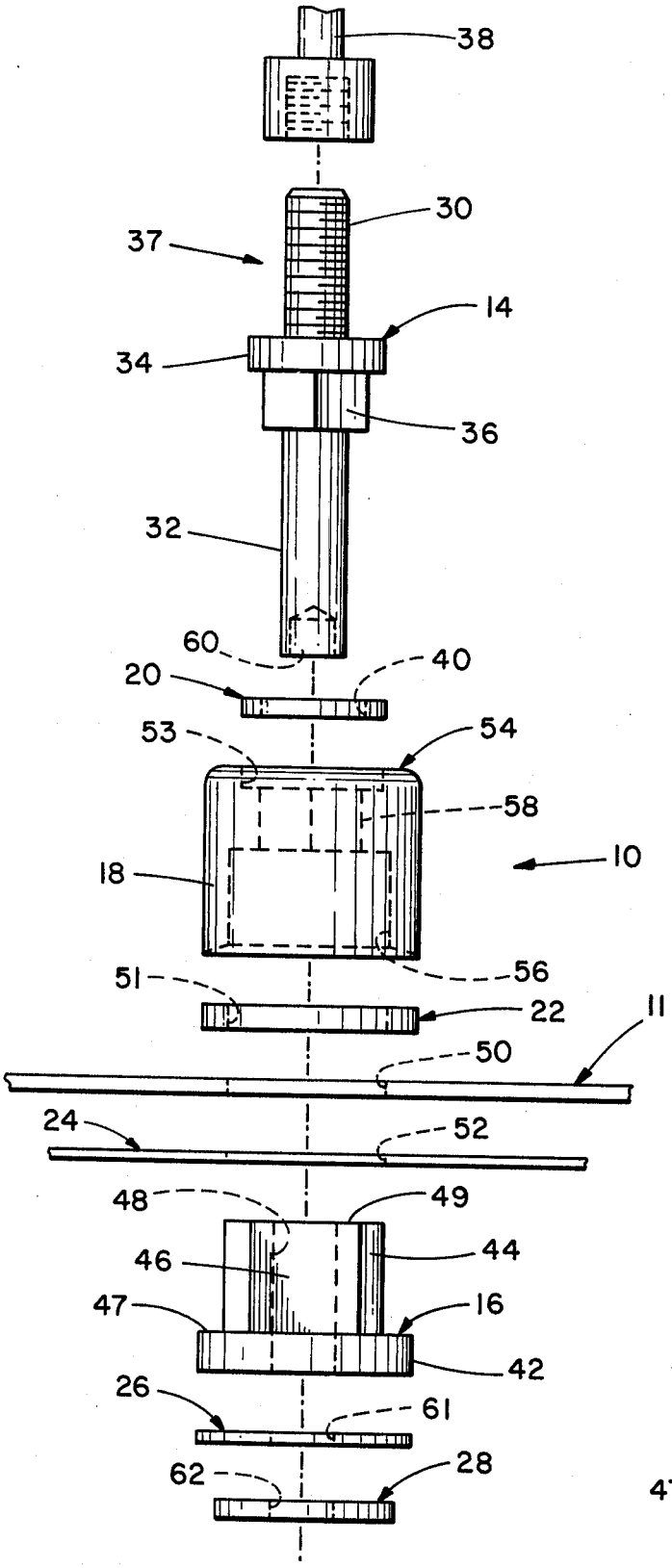
FIG. 1 is an exploded, front view of a preferred embodiment of the present invention.
Figure 6:
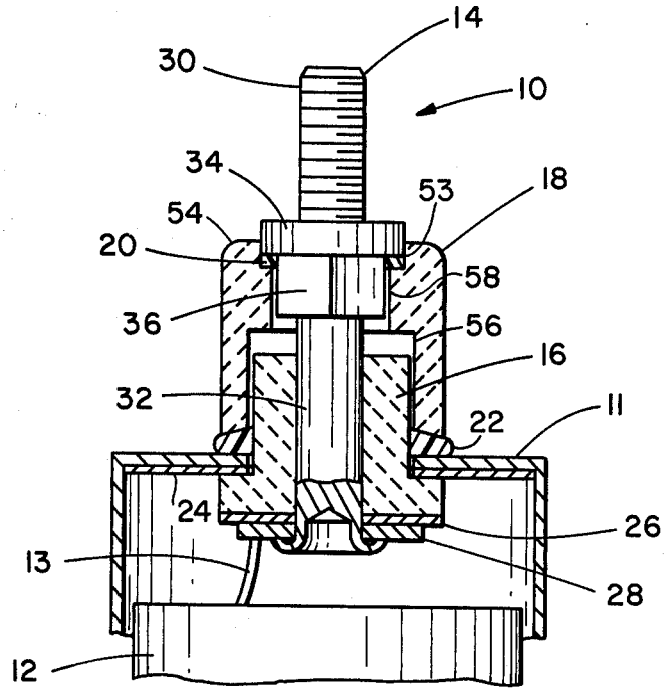
FIG. 6 is a partial cross-sectional view of the preferred embodiment of FIG. 1, shown in an assembled state.

A preferred embodiment of the present invention is shown in FIGS. 1 and 6 as a mountable, self-locking terminal assembly 10. As shown, the terminal assembly is mounted on a capacitor can or cover 11 and interconnected with a capacitor pack 12 through a conductive strip or wire 13.

It is to be understood that this embodiment or use illustrates a single application of the terminal assembly 10. For example, the terminal assembly 10 can be mounted on a cabinet (not shown), housing a series of electrically interconnected capacitors. Thus, the thickness of the cover or mounting plate 11 may vary from approximately 0.010–0.25 inches.

Figure 2:
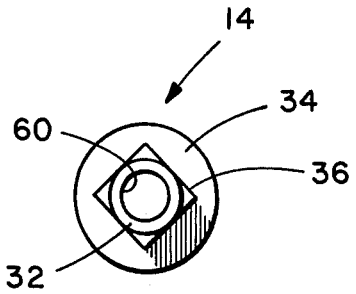
FIG. 2 is a bottom view of a terminal stud for use in the preferred embodiment shown in FIG. 1.

The terminal assembly 10 includes a terminal stud 14, an interior insulating member 16, an exterior insulating member 18, sealing gaskets 20, 22, an insulator 24 and washers 26, 28. As best shown in FIGS. 1 and 2, the terminal stud 14 is an integral, single-piece conductive element, including first and second end portions 30, 32, a collar portion 34 and a shank portion 36. The collar portion 34 is intermediate the first and second end portions 30, 32, and the shank portion 36 is adjacent the collar portion 34, opposite the first end portion 30. Preferably, the terminal stud 14 is copper.

The first end portion 30, second end portion 32 and collar portion 34 are substantially circular and coaxial. The collar portion 34 has the greatest diameter. The first end portion 30 of the terminal stud 14 provides means, generally designated 37, for connecting a conductor or wire 38 to the terminal assembly 10. The first end portion 30 can be unthreaded, internally threaded or externally threaded, as particularly shown.

Referring now to FIG. 2, the shank portion 36 of the terminal stud 14 is substantially axially aligned with the collar portion 34. The shank portion 36 is preferably square.

The sealing washer 20 is substantially circular, having a diameter substantially equivalent to the diameter of the collar portion 34. The sealing washer 20 is adapted to interlockingly receive the shank portion 36 of the terminal stud 14. That is, the sealing washer 20 defines a preferably square opening 40, dimensionally similar to the shank portion 36. The sealing gasket 20 is silicone rubber or any similar sealing material.

As used throughout the specification, the terms "interlock," "interlockingly receive" and variations thereof refer generally to axial rotation of one component with respect to another. In an interlocked state, such rotation is substantially avoided and the components are effectively keyed together. Thus, rotation of the terminal stud 14 with respect to the sealing washer 20 is substantially avoided. Further, any component shape or configuration performing the interlock function may be utilized, despite the disclosure of preferred shapes or configurations.

Figure 3:
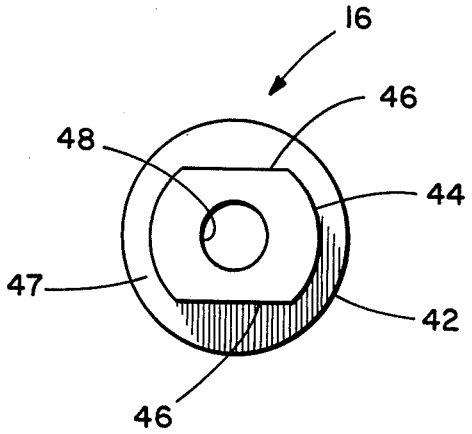
FIG. 3 is a top view of an interior insulating member for use in the preferred embodiment shown in FIG. 1.

The interior insulating member 16 includes a flange portion 42 and crown portion 44. As best shown in FIG. 3, the flange portion 42 is substantially circular and the crown portion 44 is preferably in the shape of a flattened circle, having straight sides or edges 46. As shown, the flange portion 42 extends laterally beyond the perimeter of the crown portion 44 to define a retention surface 47.

The interior insulating member 16 also defines a passage 48 therethrough. The passage 48 extends longitudinally from the top 49 of the crown portion 44 through the flange portion 42. As best shown in FIG. 6, the passage 48 is adapted to receive the second end portion 32 of the terminal stud 14. The interior insulating member 16 is preferably unglazed steatite.

Referring again to FIGS. 1 and 6, the cover 11, sealing gasket 22 and insulator 24 are adapted to interlockingly receive the interior insulating member 16 and, more particularly, the crown portion 44 thereof. That is, the cover 11, sealing gasket 22 and insulator 24 define openings 50, 51, 52, respectively, having a shape similar to the crown portion 44. As shown, the sealing gasket 22 interposes the exterior insulating member 18 and cover 11; the insulator 24 interposes the flange portion 42 of the interior insulating member 16 and cover 11.

Figure 4:
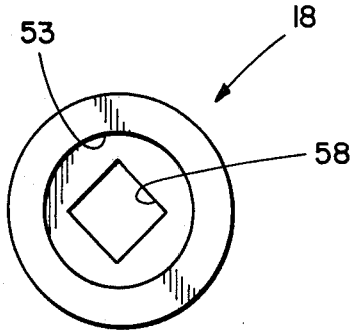
FIGS. 4 and 5 are top and bottom views, respectively, of an exterior insulating member for use in the preferred embodiment shown in FIG. 1.
Figure 5:
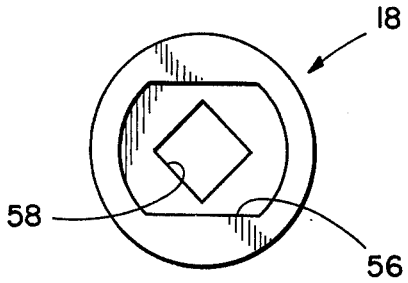

Referring now to FIGS. 1, 4 and 5, the exterior insulating member 18 is substantially circular and defines a first cavity 53 at one end 54 thereof, a second cavity 56, opposite cavity 53, and a connecting passage 58 therebetween. The external insulating member 18 is preferably steatite, with all external surfaces glazed.

The first cavity 53 is substantially cylindrical and adapted to receive the sealing washer 20 and collar portion 34 of the terminal stud 14. The second cavity 56 and connecting passage 58 are adapted to interlockingly receive the crown portion 44 of the interior insulating member 16 and the shank portion 36 of the terminal stud 14, respectively. Thus, in the assembled state, the terminal stud 14, interior insulating member 16, exterior insulating member 18 and mounting base or cover 11 are mutually interlocked.

As best shown in FIGS. 1, 2 and 6, the second end portion 32 of the terminal stud 14 is hollow and defines a chamber 60. The second end portion 32, in the assembled state, extends beyond the flange portion 42 of the interior insulating member 16 to receive washers 26, 28 through openings 61, 62, respectively. The end portion 32 is riveted to secure the terminal assembly 10 to the cover 11. More particularly, the cover 11 is securedly clamped between the interior insulating member 16 and exterior insulating member 18 in the assembled state.

The insulator 24 and washer 26 are a kraft and cushion the interior insulating member 16 from the shock of the assembly or riveting operation. The washer 28 is a metallic washer, preferably brass, and provides a solid base for the terminal assembly 10, or more particularly, the riveted end 32 of the terminal stud 14. The washer 28 also provides sufficient area for attachment of lead 13.

The compression of the sealing gaskets 20, 22 in the assembled state hermetically seals to the terminal assembly 10 and capacitor, shown in FIG. 6. Leakage of the impregnating dielectric is, therefore, substantially avoided.

The mutual interlocking of the cover or base 11, terminal stud 14, interior insulating member 16 and exterior insulating member 18 substantially avoids rotation of the terminal assembly 10 with respect to the base 11. That is, with the terminal components interlocked or keyed together, the terminal assembly 10 responds to a rotational torque as a single unit or structure. Interlocking of this single unit to the cover or base 11, and clamping thereto, provides a torque resistance up to the fracture point or stress of the cover 11.

Figure 7:
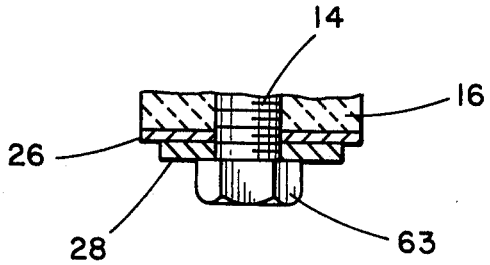
FIGS. 7 and 8 are front views of alternative means for maintaining the terminal assembly in the assembled state shown in FIG. 6.
Figure 8:
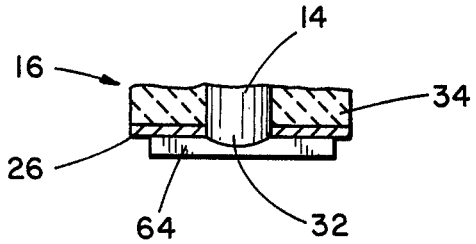

Alternative means for securing the terminal assembly 10 to the cover 11 are shown in FIGS. 7 and 8. The alternative methods include, respectively, a bolt 63 and internal threading of the end portion 32 and projection welding of a conductive plate 64 to the terminal stud 14.

Referring again to FIG. 6, the interior insulating member 16 encompasses and encloses the conductive terminal stud 14 in the vicinity of the mounting plate 11. Thus, the terminal stud 14 is insulated and grounding to the plate 11 is substantially avoided.

Further, small open spaces exist between primarily the terminal stud 14, interior insulating member 16 and exterior insulating member 18. In hermetic applications, the open spaces fill with the impregnating dielectric of the capacitor to increase the insulating properties of the terminal assembly 10. The dimensions of the terminal assembly 10, i.e., the physical separation of electrically conductive parts, also substantially avoids surface-tracking tendencies.

As discussed above, the terminal stud 14 is a one-piece conductive element, without weld points. Thus, the terminal stud 14 will withstand high current, without development of "hot spots" caused by incomplete bonding.

The physical parameters of the terminal assembly 10 may be altered for various current voltage and frequency applications. Additionally, the telescoping action of the interior insulating member 16 into the exterior insulating member 18 permits use of various mounting plate thicknesses. A single preferred embodiment of the present invention has been fully disclosed and described herein. It is to be understood, however, that various modifications and changes can be made without departing from the true scope and spirit of the present invention, as set forth and defined in the following claims.

What is claimed is:

1. A self-locking terminal assembly for a capacitor containing an impregnating fluid, said capacitor defining an opening therethrough, comprising, in combination:

an integral terminal stud including a first and second end portion, a collar portion intermediate said first and second end portions and a shank portion adjacent said collar portion;

an interior insulating member including a flange portion and a crown portion, said interior insulating member defining a passage therethrough, said opening interlockingly receiving said crown portion in an assembled state;

an insulator having an insulator opening, said insulator opening interlockingly receiving said crown portion of said interior insulating member, said insulator interposing said flange portion and said capacitor in said assembled state;

an exterior insulating member defining a first and second cavity and a connecting passage therebetween, said second cavity telescopically and interlockingly receiving said crown portion of said interior insulating member in said assembled state, said connecting passage substantially aligning with said passage of said interior insulating member, whereby said first and second insulating members receive said terminal stud, said passage and said first cavity receiving said second end portion and said collar portion, respectively, of said terminal stud, said connecting passage interlockingly receiving said shank portion, said integral terminal stud, interior insulating member and exterior insulating member defining a free space therebetween in said assembled state;

a first sealing member interposed said capacitor and said exterior insulating member; and means for securedly clamping said capacitor between said insulator and said exterior insulating member in said assembled state, whereby said capacitor, terminal stud, interior insulating member and exterior insulating member are mutually interlocked to substantially avoid rotation of said terminal assembly with respect to said capacitor;

said insulator defining means for providing access to said free space for said impregnating fluid to substantially improve the voltage characteristics of said capacitor.

2. A mountable, self-locking terminal assembly as claimed in claim 1 wherein said first end portion of said terminal stud defines means for connecting conductive means to said terminal assembly.

3. A mountable, self-locking terminal as claimed in claim 1 wherein said first end portion of said terminal stud is threaded.

4. A mountable, self-locking terminal assembly as claimed in claim 1 further comprising a second sealing member adjacent said collar portion and adapted to interlockingly receive said shank portion of said terminal stud, said first sealing member being adapted to interlockingly receive said crown portion of said interior insulating member, said first and second sealing members hermetically sealing said terminal assembly.

5. A mountable, self-locking terminal assembly as claimed in claim 4 wherein said first and second sealing members are resilient gaskets.

6. A mountable, self-locking terminal assembly as claimed in claim 1 wherein said second end portion of said terminal stud is riveted to define said clamping means.

7. A mountable, self-locking terminal assembly as claimed in claim 1 wherein said clamping means includes a threaded bolt, said second end portion of said terminal stud being adapted to receive said threaded bolt.

8. A mountable, self-locking terminal assembly as claimed in claim 1 further comprising washer means interposed said interior insulating member and said clamping means.

9. A mountable, self-locking terminal assembly as claimed in claim 8 wherein said washer means includes a metal washer.

10. A mountable, self-locking terminal assembly as claimed in claim 9 wherein said washer means further includes a kraft washer interposed said metal washer and said interior insulating member.

11. A mountable, self-locking terminal assembly as claimed in claim 1 wherein said insulator is a kraft.

12. A mountable, self-locking terminal assembly as claimed in claim 1 wherein said interior insulating member and said exterior insulating member cooperatively define means for physically separating said integral terminal stud and said capacitor to substantially avoid surface tracking of a current through said assembly.

* * * * *